US005878467A

United States Patent [19]

Yokota

[11] Patent Number: 5,878,467

[45] Date of Patent: Mar. 9, 1999

[54] CONNECTOR-EQUIPPED CORD

[75] Inventor: Masato Yokota, Toyama-ken, Japan

[73] Assignee: YKK Corporation, Tokyo, Japan

[21] Appl. No.: 862,399

[22] Filed: May 23, 1997

[30] Foreign Application Priority Data

May 27, 1996 [JP] Japan ..... 8-131687

[51] Int. Cl.[6] ..... A44B 21/00; A44B 19/26; A45C 13/30

[52] U.S. Cl. ..... 24/429; 24/265 EE; 24/431

[58] Field of Search ..... 24/429, 431, 415, 24/403, 265 EE

[56] References Cited

U.S. PATENT DOCUMENTS

| | | | |
|---|---|---|---|
| 3,462,803 | 8/1969 | Horton . | |
| 4,790,050 | 12/1988 | Ishii | 24/429 |
| 4,823,447 | 4/1989 | Akashi | 24/429 |
| 4,984,338 | 1/1991 | Akashi | 24/431 |
| 5,416,951 | 5/1995 | Keyaki et al. | 24/431 |
| 5,690,444 | 11/1997 | Yuuki et al. | 24/429 X |

FOREIGN PATENT DOCUMENTS

| | | |
|---|---|---|
| 0 287 060 A1 | 10/1988 | European Pat. Off. . |
| 0 303 217 A1 | 2/1989 | European Pat. Off. . |
| 0 369 438 A1 | 5/1990 | European Pat. Off. . |
| 0 398 172 A1 | 11/1990 | European Pat. Off. . |
| 0 502 472 A1 | 9/1992 | European Pat. Off. . |
| 63-99 608 U | 12/1988 | Japan . |

*Primary Examiner*—Anthony Knight
*Assistant Examiner*—Robert J. Sandy
*Attorney, Agent, or Firm*—Hill & Simpson

[57] ABSTRACT

A connector-equipped cord comprises: a flat belt having on its opposite ends a number of ridges molded of thermoplastic resin; a metallic connector having a pair of jaws adapted to clamp said ends of said flat belt, said jaws having on their inner surfaces a number of teeth engageable with said ridges; and a connecting ring projecting from one end of said connector remotely from said jaws.

23 Claims, 6 Drawing Sheets

CONNECTOR-EQUIPPED CORD

BACKGROUND OF THE INVENTION

1. Field of the Invention

This invention relates to a connector-equipped cord, which has at one end thereof a connector, for use as a handle string for a porch, a folding umbrella, a handy phone, etc. and also as a pull string for a slide fastener slider.

2. Description of the Related Art

In a conventional handle string of this type for porches, folding umbrellas, handy phones, etc., a cord is inserted through a ring or a swivel connector and is fixed to it by a screw or a ring holder. Then in use, the ring or swivel connector is attached to a porch, a folding umbrella, a handy phone, etc. Further, as a pull string for a slide fastener slider, it is known to insert a cord through a hole in a free end of a pull tab of the slide fastener slider and is fixed to it by a screw, and then to attach the resulting slide fastener to an opening in, for example, a porch.

Further, FIG. 10 of the accompanying drawings shows a cord disclosed in Japanese Patent Publication No. Hei 1-48761. In this conventional cord, opposite ends of the cord 102 abut with each other to form a loop and embedded in a thick-plate terminal 103 molded of thermoplastic resin having a central hole 112.

FIG. 11 shows a slide fastener slider pull tab disclosed in Japanese Utility Model Publication No. Hei 5-10654. This conventional pull tab is composed of a first member 201 made of metal or hard thermoplastic resin and having a connecting ring at one end and an engaging portion 204 in a form of a transverse T groove at the other end, and a second member 202 made of soft and elastic thermoplastic resin and having an engaged portion 207 in a form of an enlarged head, which is to be fitted in the T groove, at one end and a ribbed grip at the other end.

FIG. 12 shows an attaching member, for a pull tab of a slide fastener slider, which is disclosed in Japanese Utility Model Publication No. Hei 1-89006. This attaching member, which is made of resiliently deformable material, has at one end a ring 305 to be loosely attached to a pull-tab-attaching lug on a slider body and at the other end a pair of jaws 303 for clamping a free end of the pull tab 302, each jaw 303 having on its inner surface a number of teeth 304 extending in different directions.

However, in any of the conventional handle cords using a ring or a swivel connector, since the cord is inserted through the ring or the swivel connector and is then folded, and thereafter, the folded portion is secured by the screw or the ring holder, great load would act on the folded portion when the cord tab is pulled or turned, thus damaging the cord so that adequate durability cannot be expected.

In the cord of FIG. 10, since the abutting opposite ends 107 of the cord 102 are embedded in the terminal 103 molded of thermoplastic synthetic resin by injection molding means, only non-stable connection of the cord 102 can be achieved. Also this conventional cord requires a relatively complex manufacturing process and therefore is not suitable for mass production.

Further, in the conventional pull tab of FIG. 11, since a neck portion of the enlarged head of the engaged portion 207 of the second member 202 is smaller in thickness than the remaining portion, there is a danger that the pull tab might be damaged if a great pull force acts on the pull tab while using. In the conventional pull tab attaching member of FIG. 12, since the teeth 304 on the inner surface of each of the opposite jaws 303 of the attaching member have to be formed so as to extend in different directions, it needs a complex manufacturing process for such attaching member, thus causing only a limited rate of production.

SUMMARY OF THE INVENTION

It is a primary object of this invention to provide a connector-equipped cord, as a handle string or a slide fastener slider pull string, having a mechanism which can attach a connector having at one end a connecting ring, firmly to ends of a flat belt in a simple operation and which improves the rate of production and hence is suitable for mass production.

A second object of the invention is to provide a connector-equipped cord which is suitable for various kinds of uses by specifying a form of connecting mechanism among various selective forms of the cord.

A third object of the invention is to provide a connector-equipped cord having a connector which can be attached precisely and simply to a belt by specifying a material and a structure among different selective materials and structures of the belt.

A fourth object of the invention is to provide a connector-equipped cord having a connector which can be attached to a belt precisely and simply by specifying a connecting mechanism on the belt and a connecting mechanism on the connector among various selective forms, and having a connector which can be selected from various kinds and adequately durable.

According to a first aspect of the invention, the objects are accomplished by a connector-equipped cord, which is to be used as a handle cord or a slide fastener slider pull string, comprising: a belt having on each of its opposite ends at least one ridge molded of thermoplastic resin; a metallic connector having a pair of jaws adapted to clamp the ends of the belt, the jaws having on their inner surfaces a number of teeth engageable with the ridges; and a connecting ring projecting from one end of the connector remotely from the jaws. The ridges may be arranged in two rows on one surface of each of the ends of the belt, and the teeth are arranged in two rows on the inner surface of each of the jaws of the connector, which has a bifurcated shape, the ridges on the ends of the belt being clamped by the teeth as the jaws of the connector are pressed toward each other, the belt being a single or double form.

According to a second aspect of the invention, the objects are accomplished also by a connector-equipped cord comprising: a belt having on each of its opposite ends a plate molded of thermoplastic resin, the plate having in its surface a central recess extending transversely and a guide surface adjacent to the central recess extending transversely; a metallic connector having a clamping member of U-shape cross section, adapted to clamp at least one of the ends of the belt, the clamping member having at least one tooth projecting centrally from each of the inner surfaces thereof so as to be fitted in the respective recesses in a snap action, the belt being a single or double form. The guide surface may be a bottom surface of a stepped side groove, the bottom surface having a slope, while the tooth has a slope. Further, the plate may have a generally S-shape recess, the guide surface having a slope, while a plurality of teeth are arranged in a staggered pattern respectively on each inner surface of the clamping member, so as to be received in the S-shape recess.

Preferably, the ridge or the plate may be disposed respectively on one surface of each of the ends of the belt. The ridge or the plate may be integrally molded with the belt by an injection molding means.

Further, it is preferable that the belt is bent in a U-shape so as that the opposite ends having the ridges or the plates are clamped by the jaws or the U-shape cross-section clamping member of the connector.

Furthermore, the ridges or the plates may be disposed on both surfaces of each of the ends of the belt by an injection molding means.

Also preferably, the belt may be a braid, a knit string, a knit or woven tape, each of which is formed of synthetic fiber yarns, such as polyamide, polyester, polyvinylalchol, polyethylene or polypropylene, or a flat string formed of a non-woven synthetic fiber cloth, or a flat string of synthetic, artificial leather, or natural leather.

DETAILED DESCRIPTION OF THE PREFERRED EMBODIMENT

Various preferred embodiments of a connector-equipped cord according to this invention will now be described in detail with reference to the accompanying drawings.

Figure 1:
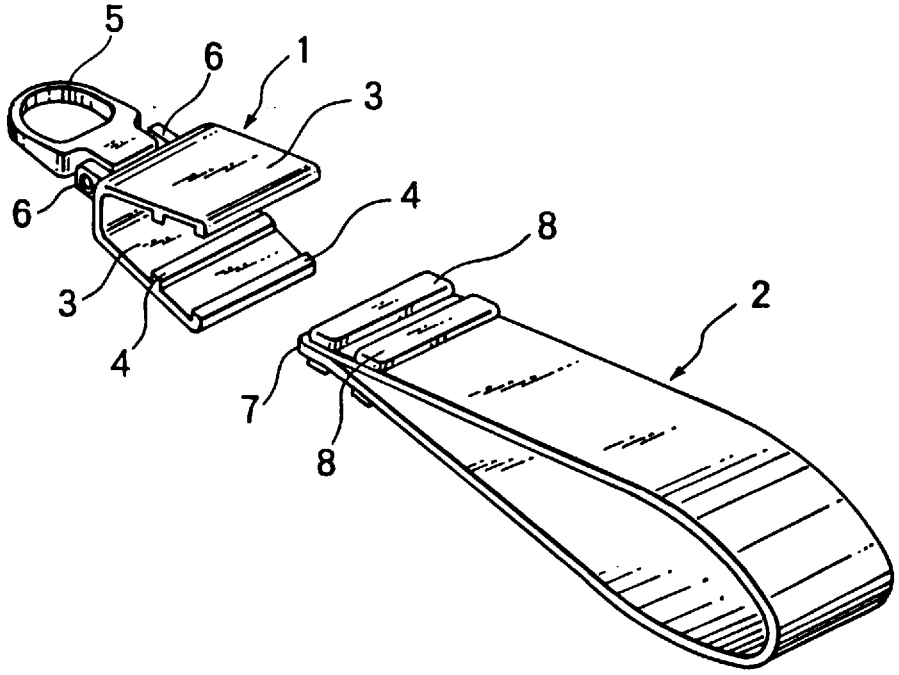
FIG. 1 is an exploded perspective view of a connector-equipped cord.
Figure 2:
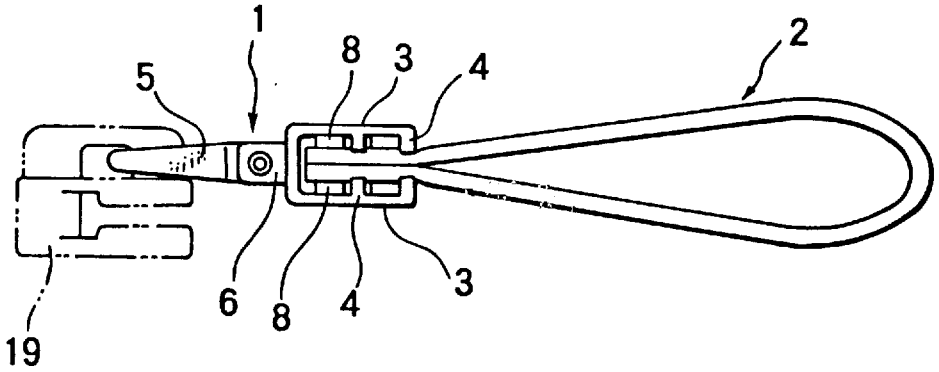
FIG. 2 is a side view of the connector-equipped cord of FIG. 1.

The connector-equipped cord (hereinafter called the cord) of this invention is particularly useful when used as a handle cord for a bag, a folding umbrella, etc., or as a pull string for a slide fastener slider. As shown in FIGS. 1 and 2, the cord is a two-member structure composed of a bifurcated connector 1 of metal and a belt 2 of synthetic fibers. The connector 1 includes a pair of jaws 3, each jaw 3 having on its inner surface two rows of transverse teeth 4 confronting those on an opposite jaw 3. The connector 1 also includes a connecting ring 5 to be attached to a product, pivotally attached to a support 6 projecting from an outer surface of a common base of the jaws 3.

The belt 2 may be a braid, a knit string or a woven tape, each of which is formed of synthetic fiber yarns such as of polyamide, polyester, polyvinylalcohol, polyethylene or polypropylene, or a stiff flat string formed of a non-woven synthetic fiber cloth, or a flat string of fake leather such as synthetic leather or artificial leather, or natural leather.

The belt 2 has on one surface of each of opposite ends 7 two rows of ridges 8 extending transversely and molded of thermoplastic resin, such as polyamide, polyacetal, polypropylene and polybutyleneterephtalate, by injection molding means. The belt 2 is folded double about its center in such a manner that the molded ridges 8 are exposed on the outer surfaces, and then the molded ridges 8 are inserted between the upper and lower jaws 3 of the connector 1 so as to be caught by the teeth 4 on the upper and lower jaws 3. Besides the ridges 8, the belt 2 end surfaces are clamped by the teeth 4. The length of the belt 2 depends on the kind of a product to which the cord is to be connected.

Figure 3:
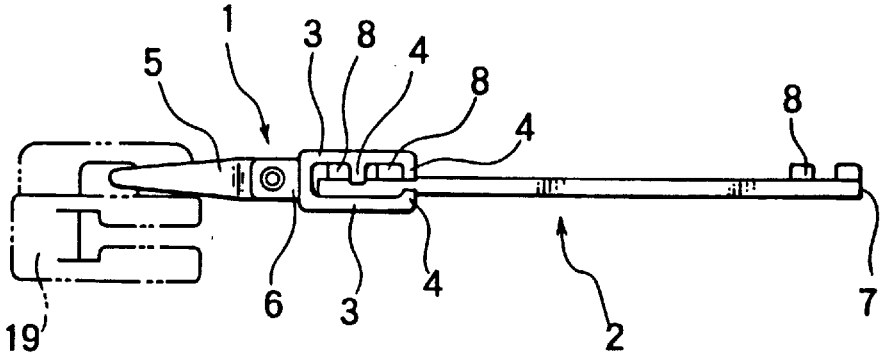
FIG. 3 is a side view of a connector-equipped cord according to a second embodiment of this invention.

FIG. 3 shows a second embodiment similar to the foregoing embodiment except that two teeth 4 project from the inner surface of the upper jaw 3 while only a single tooth 4 projects from the inner surface of the lower jaw 3. Also only one end 7 of the belt 2 which is not folded is clamped between the upper and lower jaws 3, and has molded ridges 8 facing upwardly and caught by the two teeth 4 on the upper jaw 3, while the other end 7 is left not clamped.

The two molded ridges 8 exposed on the surface of the other end 7 of the belt 2 serves to prevent the same belt end 7 from being frayed and to perform a non-skid function when the cord is used as a slide fastener pull tab.

Figure 4:
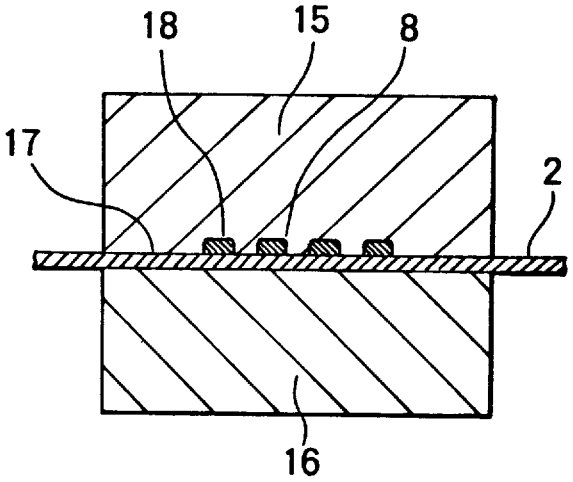
FIG. 4 is a cross-sectional view schematically showing the manner in which a number of molded ridges are formed on a belt.
Figure 5:
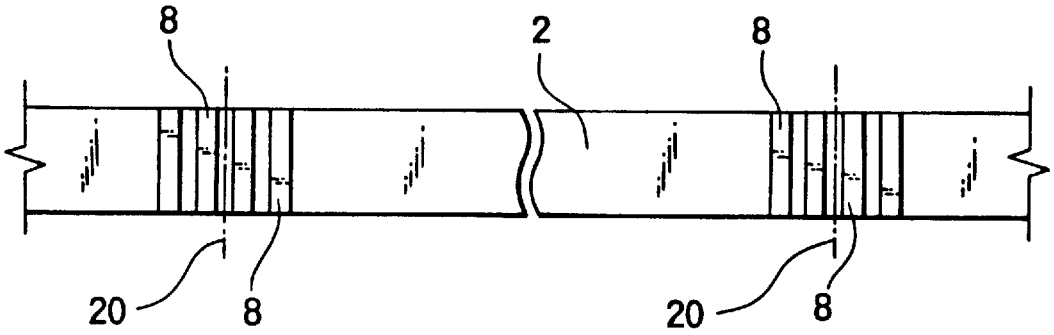
FIG. 5 is a fragmentary plan view of an elongated belt.

This belt 2 is manufactured by the injection molding means as shown in FIGS. 4 and 5. For example, a continuous length of belt 2 of synthetic fibers is continuously supplied to a molding machine in which upper and lower dies 15, 16 are disposed in confronting relation so as to define between them a belt channel 17, the upper die 15 having four ridge-forming cavities 18 spaced at equal distances and communicating with the belt channel 17. In timed relation to this continuous supply of the belt 2, thermoplastic resin is molded on an upper surface of the belt 2 by injection. Thus successive groups of four-ridges 8 are molded at equal distances on one surface of the continuous belt 2, whereupon the continuous belt 2 is severed centrally at every group of four-ridges 8 to complete individual belts 2 of a predetermined length each having two ridge 8 at each end.

Figure 6:
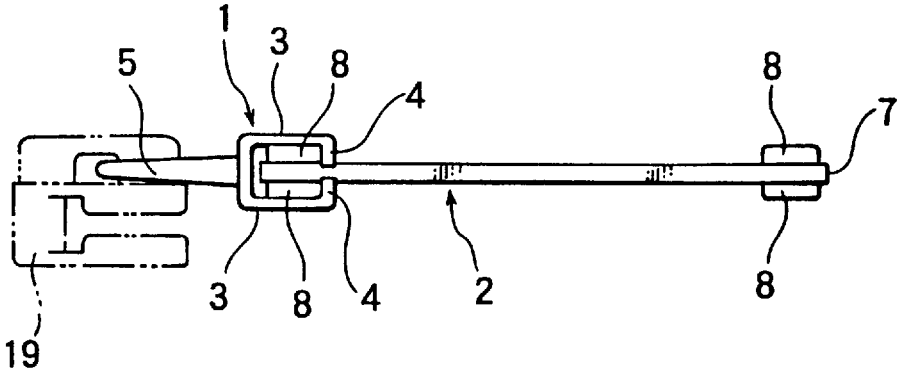
FIG. 6 is a side view of another connector-equipped cord according to a third embodiment of this invention.

FIG. 6 shows a third embodiment similar to the second embodiment except that each of opposite jaws 3 of a bifurcated connector 1 has only a single tooth 4 at its distal end and that a connecting ring 5 integrally projects from the outer surface of a common base of the opposite jaws 3. Also the belt 2 has a pair of ridges 8 molded one on each of upper and lower surfaces; the ridges 8 on the upper and lower surfaces of one belt end 7 are caught by the teeth 4 of the upper and lower jaws 3, while those on the other belt end 7 are left free. Alternatively the ridge 8 may be molded on only one surface of the belt 2.

Figure 7:
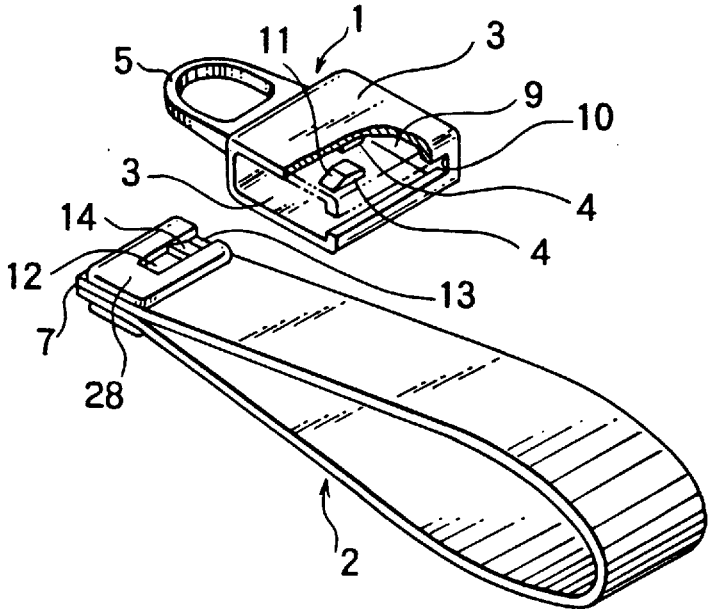
FIG. 7 is an exploded perspective view, with parts broken away, of a connector-equipped cord according to a fourth embodiment of this invention.

FIG. 7 shows a fourth embodiment in which one side of a clamping member having a U-shape cross-section is closed by a side wall 9, the clamping member 3 having in a front end thereof a slot 10 through which the belt 2 is to be inserted. Each of upper and lower inner surfaces of the clamping member 3 has a single rectangular tooth 4 projecting centrally therefrom and having at one side a slope 11. The belt 2 has on one surface at each end 7 thereof a molded plate 28 having in its surface a central recess 12 and a stepped side groove 13 communicating with the central recess 12. The side groove 13 has a slope 14 at a side toward the central recess 12.

Figure 8:
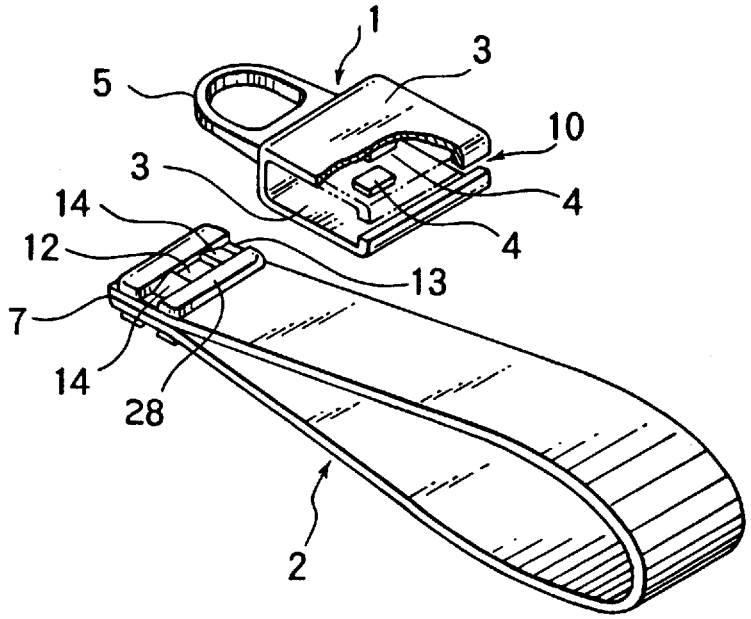
FIG. 8 is an exploded perspective view showing a connector-equipped cord according to a fifth embodiment.

FIG. 8 shows a connector-equipped cord according to a fifth embodiment. In the illustrated embodiment, the clamping member 3 having a U-shape cross section has a pair of openings at its opposite side surfaces, and has in a front end thereof a slot 10 through which the belt 2 is to be inserted. Each of upper and lower inner surfaces of the claiming member 3 has a single rectangular tooth 4 projecting centrally therefrom. The belt 2 has on one surface at each end 7 thereof a molded plate 28, in which a central recess 12 is formed. The recess 12 has on its opposite sides a pair of side grooves 13 and slopes 14 which form steps at the respective sides of the recess 12.

For connecting the thus formed connector 1 and belt 2 together, the belt 2 is folded double with the molded plate 28 facing outwardly, and the plate 28 are inserted in the U-shape cross-section clamping member 3 from either side so that the tooth 4 is moved along the side groove 13 to fit in the central recess 12, thus securing the connection between the connector 1 and the belt 2. During this inserting, the tooth 4 can be smoothly moved from the side groove 13 to the central recess 12 owing to the slope 14.

Figure 9:
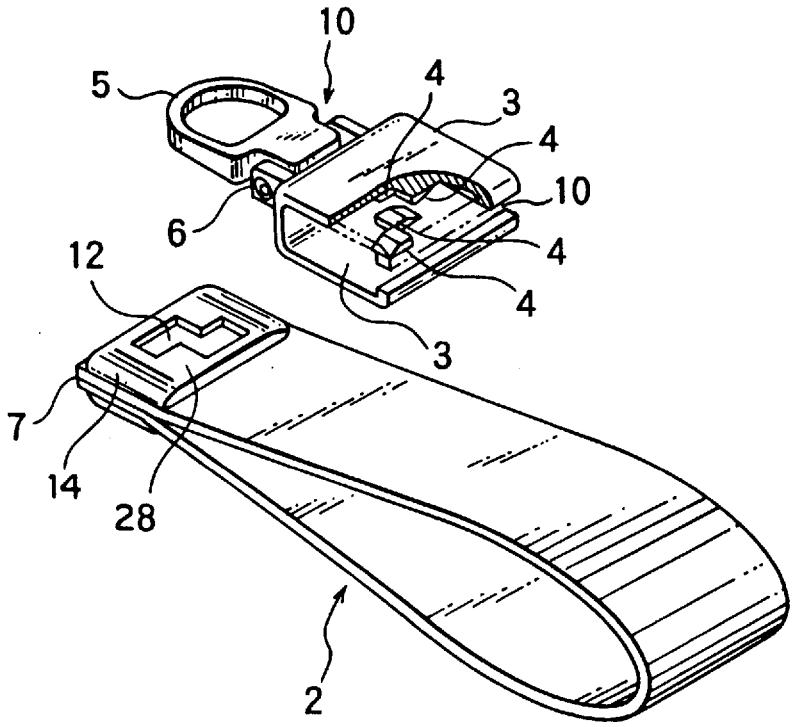
FIG. 9 is an exploded perspective view showing a connector-equipped cord according to a sixth embodiment.
Figure 10:
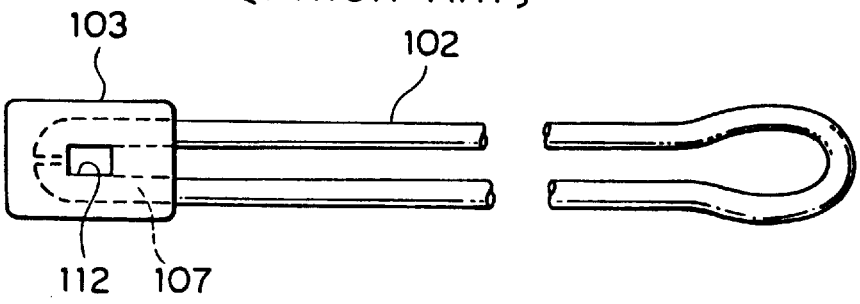
FIG. 10 [PRIOR ART]
FIG. 10 is a plan view of a conventional connector-equipped cord.
Figure 11:
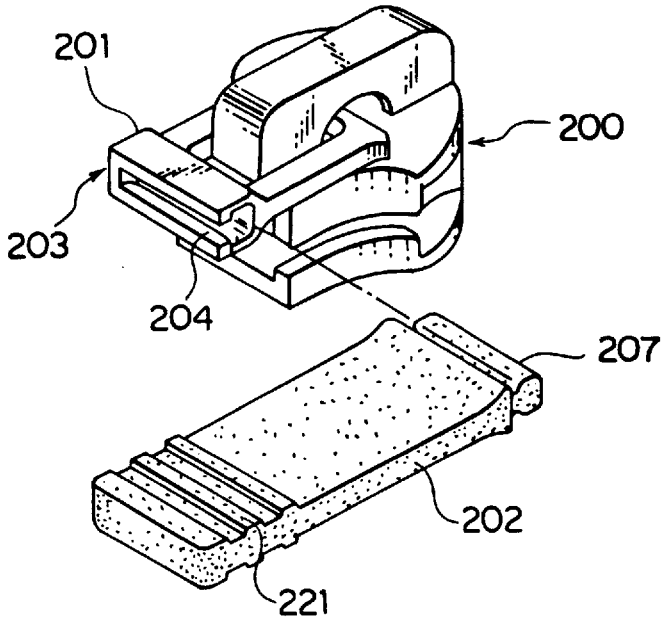
FIG. 11 (PRIOR ART)
FIG. 11 is an exploded perspective view showing a slide fastener slider in which a conventional pull tab is used.
Figure 12:
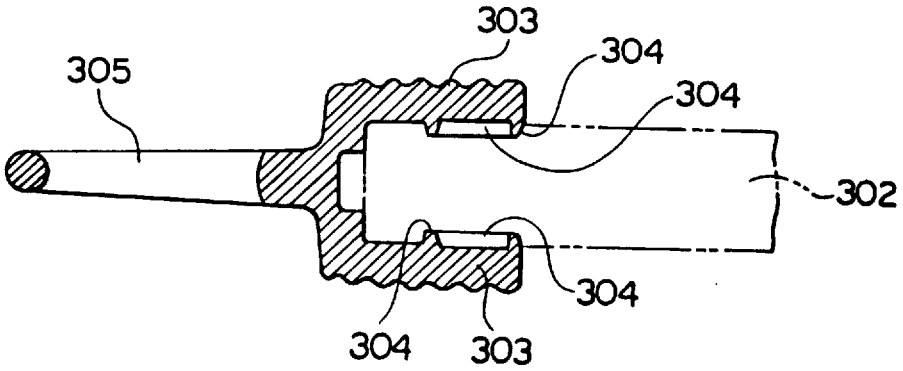
FIG. 12 (PRIOR ART)
FIG. 12 is a fragmentary longitudinal cross-sectional view showing another conventional pull tab for a slide fastener slider.

FIG. 9 shows a sixth embodiment in which two teeth 4 are arranged in a staggered pattern projecting centrally on each of the inner surfaces of the clamping member 3 of the connector 1, each tooth 4 having an outer half surface sloping dawn to its end and an inner half surface in level. On the other hand, a single plate 28 molded on each end 7 of the belt 2 has a generally S-shape recess 12 centrally in its surface for receiving the staggered two teeth 4 and has a guide surface 14 on each side to facilitate inserting the teeth 4 into the recess 12 from either side.

In the foregoing illustrated embodiments, the ridges 8 or the plate 28 may be integrally molded with the belt 2 by an injection molding means.

In FIGS. 2, 3 and 6, reference number 19 designates a slide fastener slider for which the connector-equipped cord of this invention is to be used, and in FIG. 5, reference number 20 designates cutting lines for severing the continuous belt 2 into the individual belts 2.

The connector-equipped cord of this invention has the following advantageous results:

According to the first aspect of the invention, since the metallic connector 1 has teeth 4 on the inner surface of each of upper and lower jaws 3 and a connecting ring 5 attached to the outer surface of a common base of the upper and lower jaws 3 while the belt 2 has on its ends thermoplastic resin ridges 8 to be caught by the teeth 4, it is possible to attach the belt 2, which serves as a handle string or a slide fastener slider pull string, to the connector 1 simply and neatly with adequate firmness and to improve the rate of production and hence make it suitable for mass production.

Further, partly since the belt 2 has two ridges 8 on each of opposite ends 7 while the connector 1 has two teeth 4 on the inner surface of each of the upper and lower jaws 3, and partly since the ridges 8 on opposite ends 7 of the belt 2 are clamped between the teeth 4 of the upper and lower jaws 3 as the connector 1 is compressed from the upper and lower sides, it is possible to facilitate manufacturing the connector-equipped cord.

According to the second aspect of the invention, partly since a molded plate 28 on each end of the belt 2 has in its surface a central recess 12 and a guide surface 14 adjacent to the central recess 12 while a clamping member of U-shape cross section has centrally on each of its inner surfaces a tooth 4 to be inserted in the corresponding recess 12 along the guide surface 14 from its side, it is possible to insert the belt 2 into the connector 1 sideways, thus facilitating manufacturing the connector-equipped cord.

Since the molded ridges 8 or plate 28 are disposed at least one surface of opposite ends 7 of the belt 2, it is possible to easily mold the ridges 8 or the plate 28 and to reinforce the ends 7 of the belt 2 to thereby make the connector-equipped cord durable and easy to handle.

Further, since the belt 2 is attached in a U-bent form to the connector 1, it is possible to make the connector-equipped cord easy to handle.

Furthermore, since the belt 2 is a braid, a knit string, a knit or a woven tape, each of which is composed of synthetic fiber yarns such as polyamide, polyester, polyvinylalcohol, polyethylene or polypropylene, or a flat string of non-woven cloth composed of synthetic fibers, or a flat string of synthetic leather, artificial leather, or natural leather, it is possible to fuse the thermoplastic resin ridges 8 or plate 28 with the surface of the belt 2 of synthetic fibers so that the belt 2 can be attached to the connector 1 firmly.

What is claimed is:

1. A connector-equipped cord comprising:

(a) a belt having a width greater than a thickness and on each of its opposite ends at least one ridge molded of thermoplastic resin;

(b) a metallic connector having a pair of jaws adapted to clamp at least one of said ends of said belt, each of said jaws having on its inner surface a plurality of teeth each engageable with said ridge;

(c) a connecting ring disposed at one end of said connector remotely from said jaws; and (d) wherein said belt is bent in a U-shape so that said opposite ends overlap each other and are clamped by said jaws of said connector.

2. A connector-equipped cord according to claim 1, wherein said belt is a braid, a knit string, a knit or a woven tape, which is formed of synthetic fiber yarns, or a flat string formed of a non-woven synthetic fiber cloth, or a flat string of synthetic leather, artificial leather, or natural leather.

3. A connector-equipped cord according to claim 1, wherein two ridges are arranged in rows on one surface of each of said ends of said belt, and said teeth are arranged in two rows on the inner surface of each of said jaws of said connector, which has a bifurcated shape, said ridges on said ends of said belt being clamped by said teeth as said jaws of said connector are pressed toward each other.

4. A connector-equipped cord according to claim 1, wherein said at least one ridge is disposed on one surface of each of said ends of said belt.

5. A connector-equipped cord according to claim 4, wherein said at least one ridge and said belt are integrally molded by an injection molding means.

6. A connector-equipped cord according to claim 1, further comprising at least one ridge disposed respectively on opposed surfaces of each of said ends of said belt.

7. A connector-equipped cord comprising:

(a) a flexible belt foldable onto itself and having on each of its opposite ends at least one ridge molded of thermoplastic resin wherein said belt is a braid, a knit string, a knit or a woven tape, which is formed of synthetic fiber yarns, or a flat string formed of a non-woven synthetic fiber cloth, or a flat string of synthetic leather, artificial leather, or natural leather;

(b) a metallic connector having a pair of jaws adapted to clamp at least one of said ends of said belt, each of said jaws having on its inner surface a plurality of teeth each engageable with said ridge; and (c) a connecting ring disposed at one end of said connector remotely from said jaws.

8. A connector-equipped cord according to claim 7, wherein two ridges are arranged in rows on one surface of each of said ends of said belt, and said teeth are arranged in two rows on the inner surface of each of said jaws of said connector, which has a bifurcated shape, said ridges on said ends of said belt being clamped by said teeth as said jaws of said connector are pressed toward each other.

9. A connector-equipped cord according to claim 7, wherein said at least one ridge is disposed on one surface of each of said ends of said belt.

10. A connector-equipped cord according to claim 7, further comprising at least one ridge disposed respectively on opposed surfaces of each of said ends of said belt.

11. A connector-equipped cord according to claim 4, 5, 1, 7, 9 or 10, wherein two ridges are arranged in rows on one surface of each of said ends of said belt, and said teeth are arranged in two rows on the inner surface of each of said jaws of said connector, which has a bifurcated shape, said ridges on said ends of said belt being clamped by said teeth as said jaws of said connector are pressed toward each other.

12. A connector-equipped cord comprising:

(a) a belt having on each of its opposite ends a plate molded of thermoplastic resin, the plate having in its surface a central recess and at least one guide surface adjacent to the central recess;

(b) a metallic connector having a clamping member of a U-shape cross section adapted to clamp at least one of the ends of the belt, the clamping member having at least one tooth projecting centrally from each of inner surfaces thereof so as to be inserted along said guide surface and fitted in the respective recesses;

(c) a connecting ring disposed at one end of said connector.

13. A connector-equipped cord according to claim 12, wherein said guide surface is a bottom surface of a stepped side groove, the bottom surface being a slope, and wherein said tooth has a slope.

14. A connector-equipped cord according to claim 12, wherein said plate has a generally S-shape recess, said guide surface having a slope, and wherein a plurality of teeth are arranged in a staggered pattern respectively on each inner surface of said clamping member, so as to be received in said S-shape recess.

15. A connector-equipped cord according to claim 12, 13 or 14, wherein said plate is disposed on one surface of each of said ends of said belt.

16. A connector-equipped cord according to claim 15, wherein said belt is bent in a U-shape as said opposite ends are clamped by said clamping member.

17. A connector-equipped cord according to claim 15, wherein said belt is a braid, a knit string, a knit or a woven tape, which is formed of synthetic fiber yarns, or a flat string formed of a non-woven synthetic fiber cloth, or a flat string of synthetic leather, artificial leather, or natural leather.

18. A connector-equipped cord according to claim 15, wherein said plate and said belt are integrally molded by an injection molding means.

19. A connector-equipped cord according to claim 12, 13, 14 or 18, wherein said belt is bent in a U-shape as said opposite ends are clamped by said clamping member.

20. A connector-equipped cord according to claim 19, wherein said belt is a braid, a knit string, a knit or a woven tape, which is formed of synthetic fiber yarns, or a flat string formed of a non-woven synthetic fiber cloth, or a flat string of synthetic leather, artificial leather, or natural leather.

21. A connector-equipped cord according to claim 12, 13 or 14, wherein said plate is disposed respectively on both surfaces of each of said ends of said belt.

22. A connector-equipped cord according to claim 21, wherein said belt is a braid, a knit string, a knit or a woven tape, which is formed of synthetic fiber yarns, or a flat string formed of a non-woven synthetic fiber cloth, or a flat string of synthetic leather, artificial leather, or natural leather.

23. A connector-equipped cord according to claim 12, 13, 14, 16 or 18, wherein said belt is a braid, a knit string, a knit or a woven tape, which is formed of synthetic fiber yarns, or a flat string formed of a non-woven synthetic fiber cloth, or a flat string of synthetic leather, artificial leather, or natural leather.

* * * * *

UNITED STATES PATENT AND TRADEMARK OFFICE

CERTIFICATE OF CORRECTION

PATENT NO. : 5,878,467
DATED : March 9, 1999
INVENTOR(S) : Masato Yokota

It is certified that error appears in the above-identified patent and that said Letters Patent is hereby corrected as shown below:

In column 7, line 16, claim 11 should read:

11. A connector-equipped cord according to claim 4, 5, 6,

Signed and Sealed this

Twenty-first Day of September, 1999

*Attest:*

Q. TODD DICKINSON

*Attesting Officer*

*Acting Commissioner of Patents and Trademarks*